United States Patent [19]

Smith et al.

[11] Patent Number: 4,657,259

[45] Date of Patent: Apr. 14, 1987

[54] COON HUNTERS NIGHT HUNT GAME

[76] Inventors: Lynn R. Smith, 56727 Pulver Rd., Three Rivers, Mich. 49093; George Spector, 233 Broadway RM 3815, New York, N.Y. 10007

[21] Appl. No.: 780,188

[22] Filed: Sep. 26, 1985

[51] Int. Cl.[4] ..... A63F 3/00

[52] U.S. Cl. ..... 273/244; 273/282; 273/287; 273/289

[58] Field of Search ..... 273/256, 288, 289, 244, 273/128 R, 282 R, 287; 116/324, DIG. 29, DIG. 31; 200/291

[56] References Cited

U.S. PATENT DOCUMENTS

| | | | |
|---|---|---|---|
| 1,439,616 | 12/1922 | Diehl | 273/244 |
| 1,700,016 | 1/1929 | Belanger | 273/289 |
| 2,026,082 | 12/1935 | Darrow | 273/256 |
| 2,866,433 | 12/1958 | Kallick et al. | 116/324 |
| 3,494,619 | 2/1970 | Biegonis | 273/256 |
| 3,726,527 | 4/1973 | Schauffler | 273/256 |
| 3,888,487 | 6/1975 | Replogle | 273/288 |
| 4,032,154 | 6/1977 | Magiera | 273/256 |
| 4,152,565 | 5/1979 | Rose | 200/291 |
| 4,208,984 | 6/1980 | Glanzman | 116/324 |
| 4,290,607 | 9/1981 | McDonald | 273/256 |
| 4,354,069 | 10/1982 | Ragen | 200/291 |

*Primary Examiner*—Richard C. Pinkham
*Assistant Examiner*—Stuart W. Rose

[57] ABSTRACT

A coon hunters night hunt game that simulates an outdoor racoon hunt is provided and consists of a game board in which at the end of the game the first player to accumulate 1,000 points and have ownership of three dogs win. In a modified form each hound dog playing piece has a built in stop mechanism and rides in a track on the game board so that it will stop on each space playing position.

2 Claims, 10 Drawing Figures

COON HUNTERS NIGHT HUNT GAME

BACKGROUND OF THE INVENTION

The instant invention relates generally to board games and more specifically it relates to a coon hunters night hunt game that simulates an actual outdoor racoon hunt indoors on a game board.

Coon hunters are always selling and trading their dogs, to get better racoon dogs. They like to see who gets the most coons when they have different hunts to go to. They try and win trophys by accumulating points, by striking on trails and by treeing the coons with his own dog.

Numerous board games have been provided in prior art that are adapted to simulate hunting of animals and catching fish. For example, U.S. Pat. Nos. 878,334; 3,921,981 and 4,003,578 all are illustrative of such prior art. While these units may be suitable for the particular purpose to which they address, they would not be as suitable for the purposes of the present invention as heretofore described.

SUMMARY OF THE INVENTION

A principle object of the present invention is to provide a coon hunters night hunt game that simulates an outdoor racoon hunt on a game board in which the first player to accumulate 1,000 points and have ownership of three dogs win.

Another object is to provide a coon hunters night hunt game wherein the results of each play are determined by the roll of the die and the information indicated on the space playing position the hound dog playing piece lands on.

An additional object is to provide a coon hunters night hunt game wherein each hound dog playing piece has a built in stop mechanism and rides in a track on the game board so that it will stop on each space playing position.

A further object is to provide a coon hunters night hunt game that is simple and easy to use.

A still further object is to provide a coon hunters night hunt game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
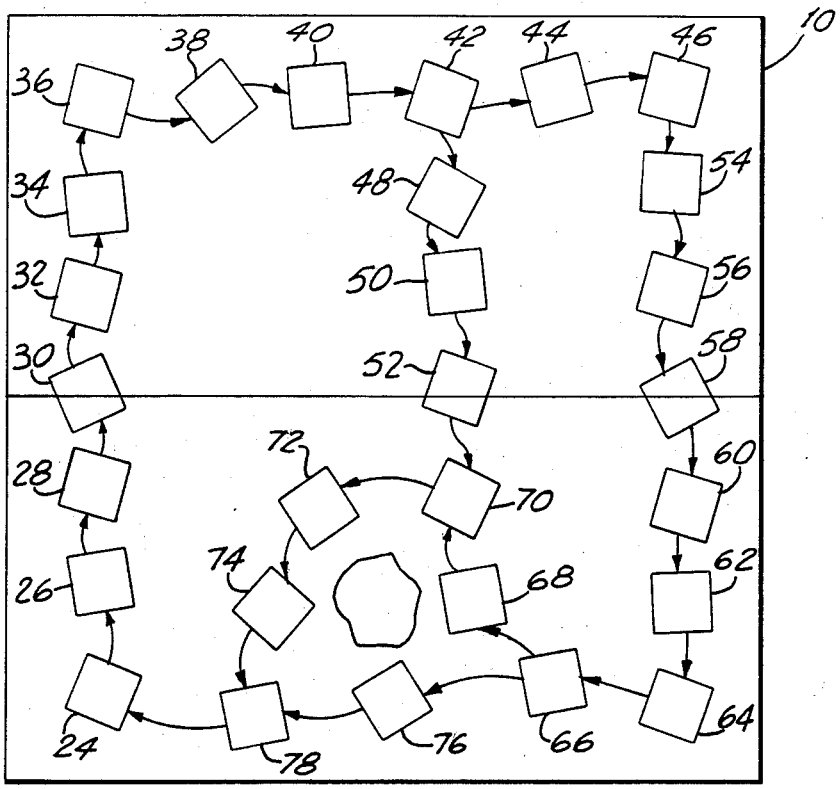
FIG. 1 is a top view of the game board
Figure 2:
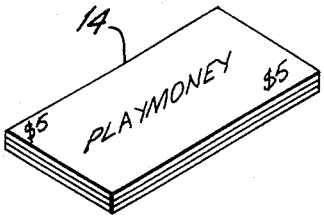
FIG. 2 is a perspective view of a stack of play money.
Figure 3:
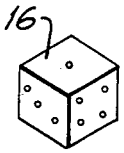
FIG. 3 is a perspective view of a die.
Figure 7:
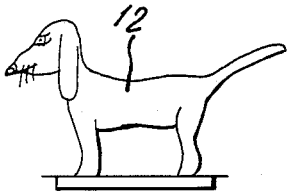
FIG. 7 is a side view of one typical hound dog playing piece.
Figure 4:
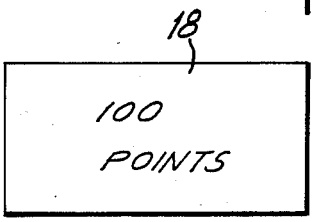
FIG. 4 is a top view of one typical point card.
Figure 5:
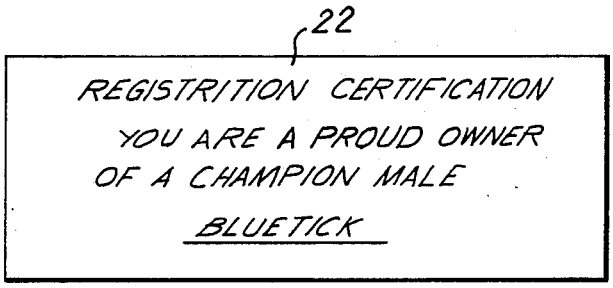
FIG. 5 is a top view of one typical dog ownership title card.
Figure 6:
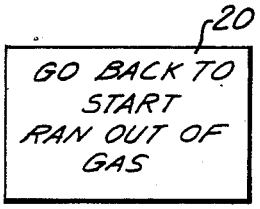
FIG. 6 is a top view of one typical chance card.

Turning now descriptively to the drawings, in which similar reference characters denote similar elements throughout the several views, FIGS. 1 through 7 illustrates equipment needed for a coon hunters night hunt game that simulates an outdoor racoon hunt indoors.

The equipment includes a game board 10, a plurality of playing pieces 12, play money 14, a die 16, a plurality of point cards 18, a plurality of chance cards 20 and a plurality of dog ownership cards 22.

The game board 10 has a plurality of space playing positions 24 to 82 forming various paths around the game board. Each space playing position bears indicia instructions during play of the game.

The playing pieces 12 are in the shapes of hound dogs of different colors representing each player and of a size to fit within the space playing positions.

The play money 14 is of different denominations for distribution of part thereof to each player. The die 16 shows how many space playing positions to move each of the playing pieces 12.

The point cards 18 have different points thereon to be chosen when each player receives points during play of the game. The chance cards 20 bear additional indicia instructions to be chosen when each player lands on the space playing position indicating a chance.

The dog ownership title cards 22 have six different breeds of coon hunting dogs being male and female. One of the dog ownership title cards 22 is chosen by each player at start of the game and added and traded when the player picks the chance card 20 during play of the game. The first player to accumulate 1,000 points and have ownership of three dog wins.

Figure 8:
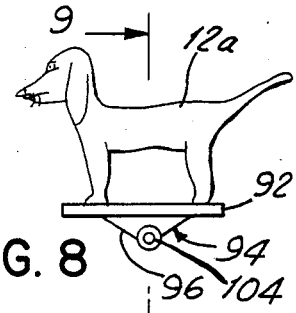
FIG. 8 is a side view of a modified hound dog playing piece in which the base has a built in stop mechanism.
Figure 9:
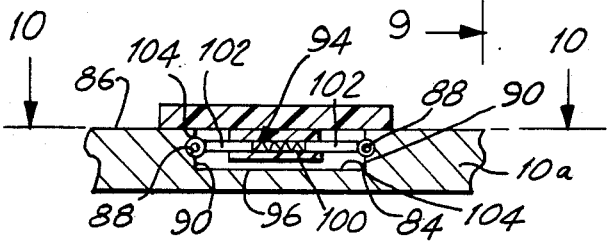
FIG. 9 is a cross sectional view taken along line 9—9 in FIG. 8 showing the base within a track in a portion of a modified game board.
Figure 10:
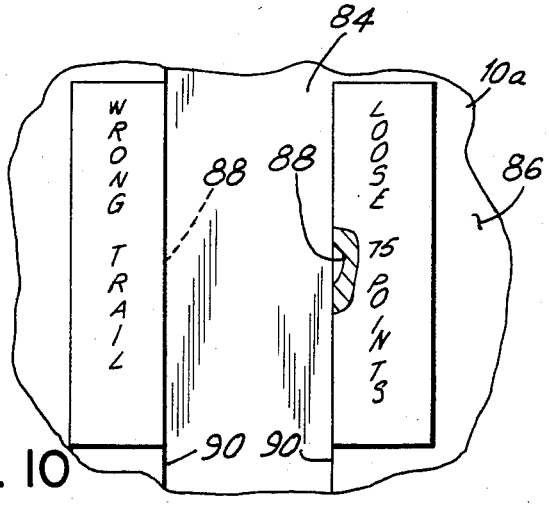
FIG. 10 is a top view taken along line 10—10 in FIG. 9 showing a portion of one of the tracks with parts broken away.

FIGS. 8 through 10 shows a modified coon hunters night hunt game. The game board **10*a* has a continuous track 84 within top surface 86 thereof to follow the various paths around the game board. Opposite positioned round stop recesses 88, 88 are on side walls 90,90 of the track 84** at each of the space playing positions.

Each of the playing pieces **12*a* has a base member 92 with a built in stop mechanism 94 to automatically stop the playing piece at the stop recesses 88, 88 within each of the space playing positions when the playing piece 12*a* is pushed along the track 84**.

Each stop mechanism 94 includes a housing 96 that has a horizontal chamber 100 within and is mounted to underside of the base member 92. A pair of opposite positioned spring biased stop members 102, 102 each having a round contact head 104, extends outwardly from the housing 96 to contact the side walls 90,90 and the stop recesses 88, 88 in the track 84.

There are preferably twenty eight space playing positions, these being numbered and labeled as follows:

24.—Start or idle time.

26.—Your lucky day—your dog won treeing contest win $100.

28.—You got first strike +100 points.

30.—Dog got hook worms—pay $50.

32.—Chance.

34.—Dog stopped to itch fleas—lose turn.

36.—Dog lost trail—lose 50 points.
38.—Your dog treed—+100 points.
40.—Your dog is best of breed—win $100.
42.—Chance.
44.—Didn't see coon—lose 50 points.
46.—Your dog striked—+100 points.
48.—Dog ran into skunk—go back three spaces.
50.—Wrong trail—lose 75 points.
52.—Seen coon on tree—+100 points.
54.—Your dog stepped in fox trap—pay $25.
56.—Dog made pit stop—lose turn.
58.—Chance.
60.—Dog bite a porcupine—go ahead 2 spaces.
62.—Good strike—+100 points.
64.—Hit a den tree—lose 75 points.
66.—Dog was fighting—pay fine of $25.
68.—Best of breed—win $100.
70.—Chance.
72.—Dog went swimming—lose turn.
74.—Go back three spaces.
76.—Seen coon in tree—+100 points.
78.—Dog chased deer—lose 100 points.

The play money 14 in the bank consists of:
ten—$500 bills,
thirty—$100 bills,
twenty five—$50 bills,
thirty five—$20 bills, and
thirty five—$5 bills.

The point cards 18 consists of twenty cards of "25 points", twenty cards of "50 points", twenty cards of "75 points" and thirty cards of "100 points". To keep the cost of the game down, the players of the game can get their own paper and pencil and keep score that way.

Some of the sayings that are on the chance cards are as follows:
If you own a bluetick—win $50.
If you own a black and tan—win $50.
If you own a Plott—win $50.
If you own a Walker—win $50.
If you own a Red Bone—win $50.
If you own a English—win $50.
Bad night—dog died from skunk fever—give up one ownership of dog.
You can buy a choice of breed for $500.
You can trade one of your breeds for another.
Go back to start run out of gas.
You can buy a choice of breed for $500.

On the dog ownership title cards 22 there are 6 different breeds of coon hunting dogs. They are English, Black and Tan, Plott, Treeing Walker, Bluetick and Red Bone. Of these dogs the Treeing Walkers are the most popular. There are ten cards of English, ten cards of Black and Tan, ten cards of Plott, twenty cards of Treeing Walker, ten cards of Blue Ticks and ten cards of Red Bone.

The dog ownership title cards 22 made would be the same for each breed of dogs, except the name of the breed would be different. Also half of the cards would say male and the other half of the cards would say female.

RULES OF THE GAME

1. Each player chooses one playing piece 12 or 12*a*.
2. Each payer starts with the following play money: three—$100's; two—$50's; four—$20's; and four—$5's.
3. Each player chooses one dog ownership title card 22 in any choice of breed.
4. The players can be between two and six in number.
5. The game is designed for players between the ages eight to adult.
6. Each players rolls the die 16 and the highest number rolled will go first.
7. The first player rolls the die, moves the number of space playing positions the die says and then reads to indicia instructions and does as it says.
8. The next player on the first player's left goes next.
9. As the game progresses on, each player accumulates points and more play money 14.
10. The only time a player can trade a dog ownership title card 22 is with a chance card 20.
11. The first player to accumulate 1,000 points and have ownership of their dogs wins.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A coon hunters night hunt game that simulates an outdoor racoon hunt indoors which comprises:

(a) a game board having a plurality of space playing positions forming a plurality of paths around said game board, each said space playing position bearing indicia instructions during play of said game;

(b) said game board having a continuous track within the top surface thereof to follow said plurality of paths around said game board and opposite positioned stop recesses on side walls of said track at each of said space playing positions;

(c) a plurality of playing pieces being in the shapes of hound dogs of different colors representing each player and of a size to fit within said space playing positions;

(d) each of said playing pieces having a base member with a built in stop mechanism to automatically stop said playing piece at said stop recesses within each of said space playing positions when said playing piece is pushed along said track, said stop mechanism having means whereby said mechanism is manually overcome by the player pushing said piece to a desired position;

(e) play money of different denominations for distribution of part thereof to each said player;

(f) a die showing how many space playing positions to move each of said playing pieces;

(g) a plurality of point cards having different points thereon to be chosen when each said player receives points during play of said game;

(h) a plurality of chance cards bearing additional indicia instructions to be chosen when said player lands on said space playing position indicating a chance;

(i) a plurality of chance positions from which a plurality of paths may be taken corresponding to a chosen chance card; and (j) a plurality of dog ownership title cards having six different breeds of coon hunting dogs being male and female, one of said dog ownership title cards to be chosen by each player at the start of said game and added and traded when said player picks said chance card during play of said game, wherein the first player to accumulate 1,000 points and have ownership of three dogs wins.

2. A coon hunters night hunt game as recited in claim 1, wherein each said stop mechanism includes:

(a) a housing having a horizontal chamber within, mounted to underside of said base member; and (b) a pair of opposite positioned spring biased stop members each having a round contact head extending outwardly from said housing to contact said side walls and said stop recesses in said track.

* * * * *